United States Patent [19]

Cobb

[11] 3,938,860

[45] Feb. 17, 1976

[54] FURNITURE FORMED OF TUBULAR ELEMENTS

[76] Inventor: Bruce Cobb, 36 E. 7th St., New York, N.Y. 10003

[22] Filed: Nov. 15, 1974

[21] Appl. No.: 524,103

[52] U.S. Cl. ..... 297/440; 297/411; 297/445; 297/452

[51] Int. Cl.[2] ..... A47C 7/00

[58] Field of Search ..... 297/452, 440, 445, 456, 297/443, 442, 411; 52/DIG. 9, 300, 656, 663; 108/56, 51; 46/25, 16, 15, 27, 28, 29; D6/67, 68; 5/348 R

[56] References Cited

UNITED STATES PATENTS

| | | | |
|---|---|---|---|
| 2,691,499 | 10/1954 | Watts | 108/56 |
| 3,023,050 | 2/1962 | Jensen | 5/DIG. 1 |
| 3,074,203 | 1/1963 | Paksy | 46/29 |
| 3,179,245 | 4/1965 | Bastian, Jr. | 242/68.5 X |
| 3,363,361 | 1/1968 | Helfer | 46/15 X |
| 3,380,581 | 4/1968 | Landgraf | 206/493 |
| 3,407,758 | 10/1968 | Simkins | 52/DIG. 9 |
| 3,420,574 | 1/1969 | Smith | 5/348 R |
| 3,504,942 | 4/1970 | Wong | 297/445 |
| 3,751,082 | 8/1973 | Somerville | 297/440 |

FOREIGN PATENTS OR APPLICATIONS

| | | | |
|---|---|---|---|
| 934,025 | 5/1948 | France | 52/DIG. 9 |

*Primary Examiner*—James T. McCall
*Attorney, Agent, or Firm*—Alan H. Levine

[57] ABSTRACT

An article of furniture comprising a plurality of rigid tubes arranged vertically in side-by-side relation, and fastened together. A load-bearing member, such as a flat board, rests upon the upper ends of at least some of the tubes. The board may carry inserts which frictionally fit into the upper ends of the tubes to help hold the tubes together in a unitary assembly. The article may include relatively short tubes for supporting the board, and relatively long tubes defining a chair back and chair arms.

9 Claims, 13 Drawing Figures

FURNITURE FORMED OF TUBULAR ELEMENTS

This invention relates to furniture, and more particularly to furniture formed of an assembly of very simple elements.

Most articles of furniture, even collapsible furniture, are composites of many different shaped elements fitted together according to a particular scheme. Thus, to assemble a conventional piece of furniture, many different parts must first be formed by the use of appropriate tools, and the parts must then be carefully assembled usually with the use of tools. The fact that many different shaped parts are needed, and the great effort required to assemble these parts, both add significantly to the cost of the furniture.

It is an object of the present invention to greatly simplify furniture construction by providing an article of furniture formed primarily from a single type of very simple element, namely, tubes.

It is another object of the invention to provide an article of furniture made primarily from very inexpensive paper tubes.

It is a further object of the invention to provide such an article of furniture which can readily be assembled without the exercise of great skill, and with only the simplest of tools, or in some cases no tools at all.

It is an additional object of the invention to provide an article of furniture which although easily assembled from inexpensive materials, is nevertheless attractive, comfortable, and sturdy.

Additional features and advantages of the present invention will be apparent from the following description in which reference is made to the accompanying drawings.

In the drawings:

FIG. 1 is a perspective view showing three tubes adhesively secured together in side-by-side relation;

FIG. 1*a* is a fragmentary top plan view of FIG. 1;

FIG. 2 is a perspective view of three tubes stapled together in side-by-side relation;

FIG. 2*a* is a fragmentary top plan view of FIG. 2;

FIG. 3 is a perspective view of three tubes bolted together in side-by-side relation;

FIG. 3*a* is a fragmentary top plan view of FIG. 3;

Figure 6:
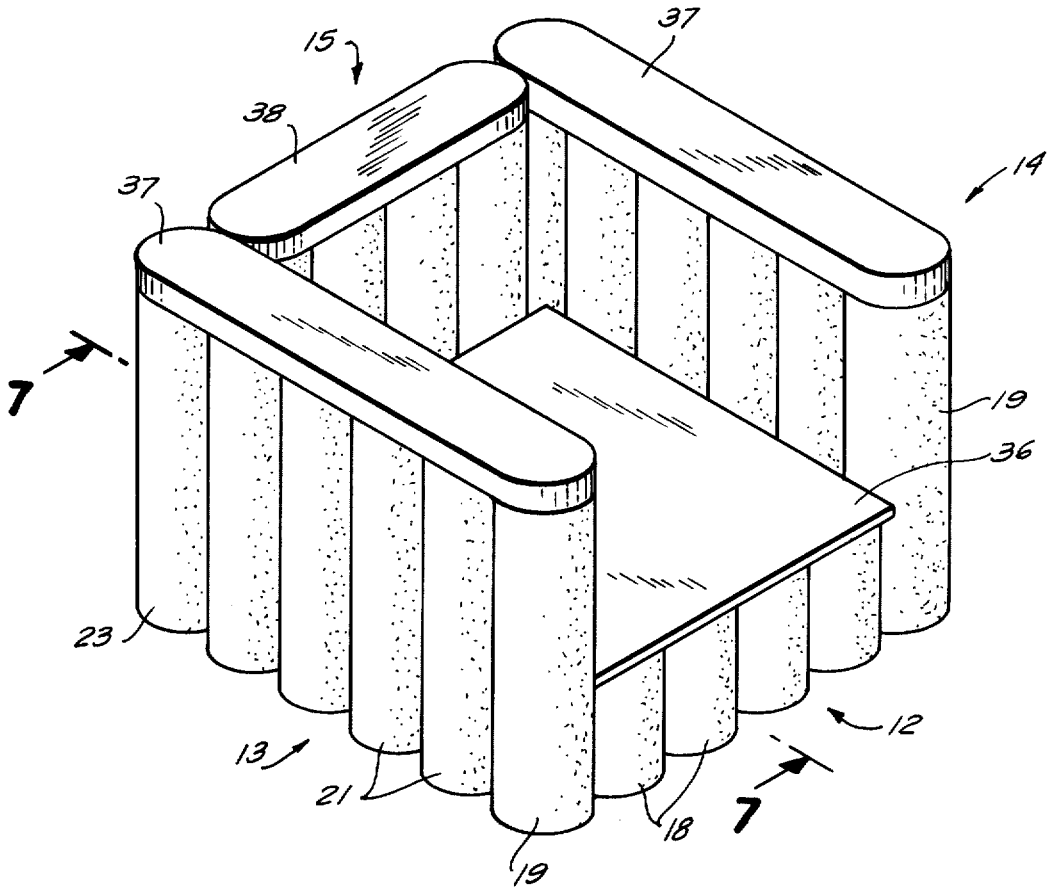
FIG. 6 is a perspective view of the chair in assembled condition.

The article of furniture chosen to illustrate the present invention is a chair, shown in FIG. 6. The chair comprises a front section 12, side sections 13 and 14, and a back section 15. Each of these sections is formed of vertically-arranged tubes fastened together in side-by-side relation.

Tubes which are admirably suited to the purposes of the present invention are the conventional paper tubes used as cores on which textile fabrics, paper, and other sheet material is wound for delivery to users of such sheet material. In common practice, once the sheet material has been used, the paper tube cores are discarded. This is an indication of the low cost of these tubes. Nevertheless, it has been found that these tubes are rigid enough to be used for furniture fabrication according to the present invention. The tubes are very strong in axial compression, and for this reason, in furniture according to the present invention the tubes are always used in a vertical orientation. Paper tubes having an outer diameter of 2¼ inches and a wall thickness of ⅛ inch have been used successfully in fabricating furniture according to this invention.

Figure 5:
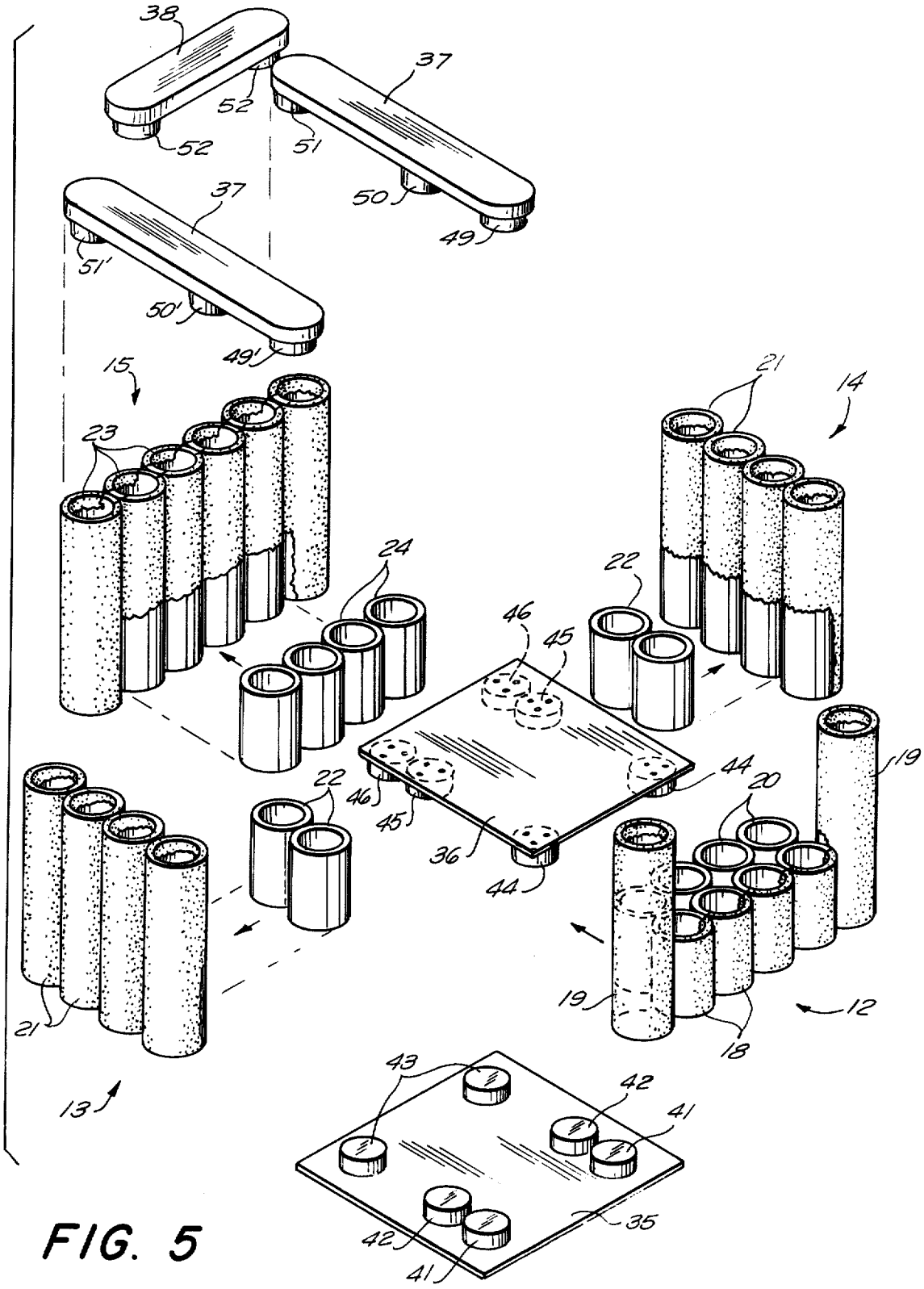
FIG. 5 is an exploded perspective view of a chair fabricated according to the present invention.

Referring to FIG. 5, it will be seen that in the present example front section 12 comprises an outer row including relatively short tubes 18 and a relatively long tube 19 at each end of the row, as well as an inner row of short tubes 20. Each of the side sections 13 and 14 comprises an outer row of relatively long tubes 21 and an inner row of relatively short tubes 22. Back section 15 comprises an outer row of relatively long tubes 23 and an inner row of relatively short tubes 24.

Figure 1:
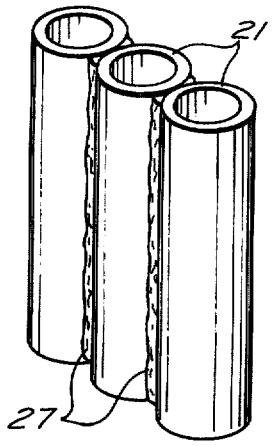
Figure 2:
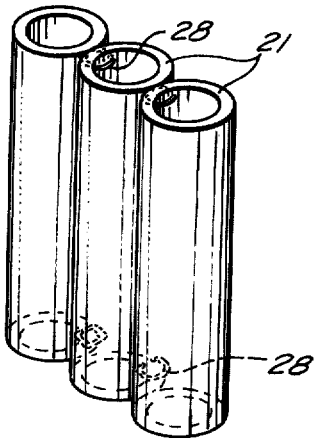
Figure 3:
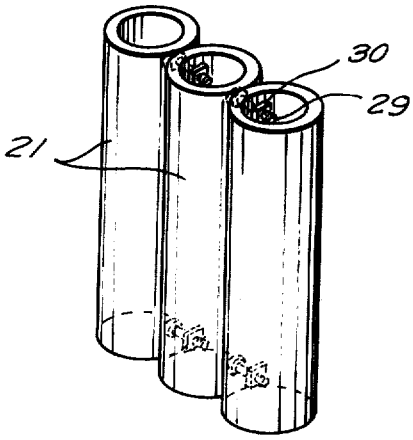

The manner in which the tubes of each section may be joined together is illustrated in FIGS. 1–3. In these figures, the relatively long tubes 21 of one of the side sections of the chair are used to illustrate the joining of the tubes. However, the fastening methods illustrated and to be described can be used will all the tubes of any particular section.

Figure 1A:
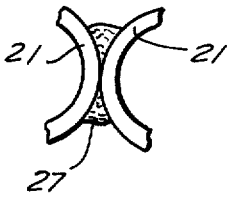
Figure 2A:
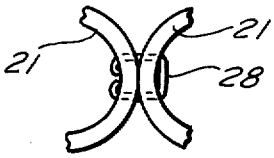
Figure 3A:
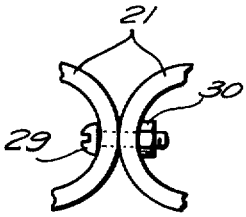

FIGS. 1 and 1*a* illustrate tubes 21 arranged parallel and side-by-side, and bonded together by a suitable adhesive 27. FIGS. 2 and 2*a* illustrate a similar arrangement of tubes 21 secured together by staples 28. If desired, for additional strength tubes 21 could be both stapled together and adhesively secured together. When the tubes are adhesively secured together and/or stapled together, the tubes of each of the sections 12–15 are permanently secured together into a unitary assembly. If it is desired that the tubes of each of the sections be separable, so that the piece of furniture can be reduced to its separate individual elements, tubes 21 can be fastened together as illustrated in FIGS. 3 and 3*a*. In this arrangement, bolts 29 pass through aligned holes in each two adjacent tubes, and are held in place by nuts 30.

Figure 4:
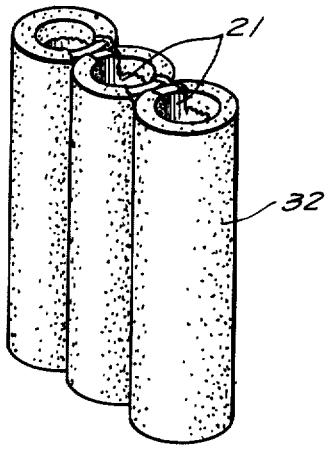
FIG. 4 is a perspective view of three interconnected tubes covered by sheet material.

After the tubes are interconnected, in any of the ways illustrated in FIGS. 1–3, or in any other suitable manner, their outer exposed surfaces may be covered by a suitable sheet material 32 (FIG. 4). The sheet material may be paper, cloth, or plastic. Preferably, this sheet material is adhesively secured to the tubes. The sheet material serves a decorative function, and also helps to hold the tubes together. Use of the sheet material is not essential, and the tubes could be left in their natural state, or painted if desired.

Figure 7:
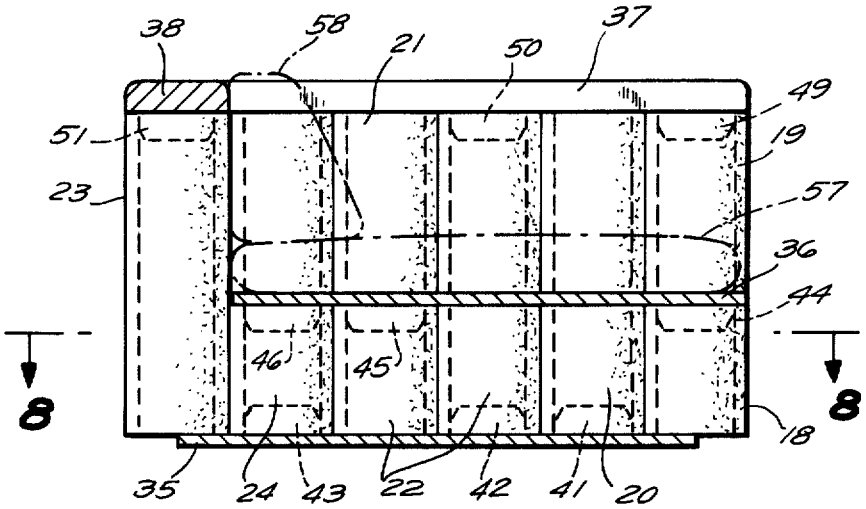
FIG. 7 is a vertical cross-sectional view taken along line 7—7 of FIG. 6.
Figure 8:
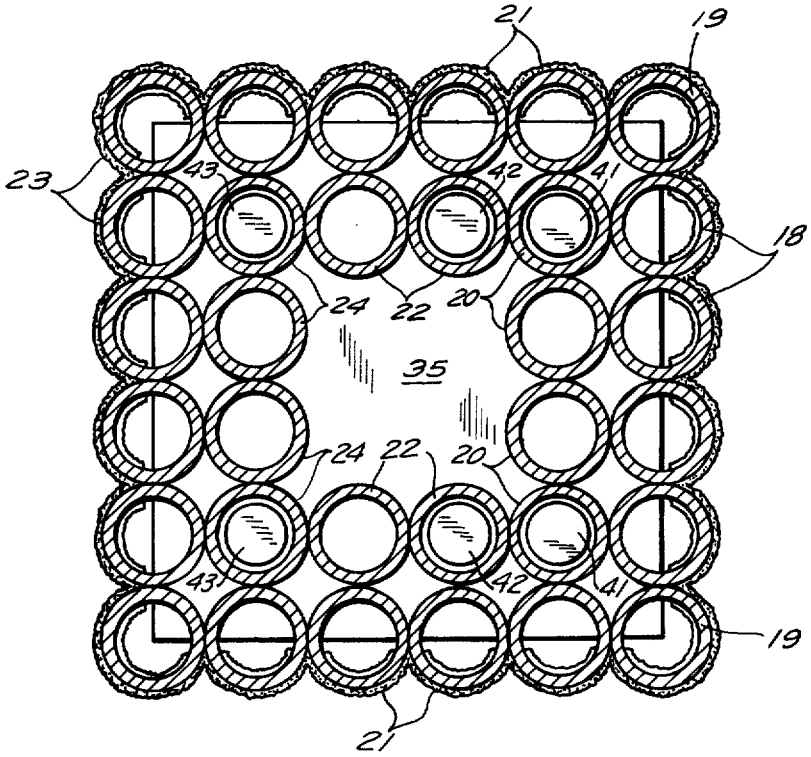
FIG. 8 is a horizontal cross-sectional view taken along line 8—8 of FIG. 7.

In addition to the parts described above, the chair of the example being described includes a rectangular base board 35 (FIGS. 5, 7, and 8), a load-bearing member in the form of a flat rectangular board 36 (FIGS. 5–7), a pair of arm slats 37 and a back slat 38 (FIGS. 5–7). Each of the boards 35 and 36 may be formed of plywood or Masionite, and the slats 37 and 38 may be formed of wood. Each of the boards 35 and 36 and slats 37 and 38 is formed with projecting cylindrical inserts sized to fit very snugly within an end of one of the tubes. The inserts may be permanently affixed to the boards and slats by suitable fastening means, such as adhesive or nails.

When the chair is to be assembled, the four sections 12–15 are arranged in a rectangular configuration upon base board 35. Two of the inserts 41 projecting from board 35 are pressed into the lower ends of two of the tubes 20 of front section 12 (see FIGS. 7 and 8). Two other inserts 42 projecting from board 35 are pressed into the lower ends of tubes 22 of chair sections 13 and 14, respectively. Another two inserts 43 projecting from board 35 are pressed into two tubes 24 of back section 15.

Board 36, which serves as a seat element, is then placed upon the upper ends of short tubes 18, 20, 22, and 24. Two inserts 44 projecting from board 36 are pressed into the upper ends of two tubes 18 of front section 12 (see FIG. 7). Two other inserts 45 are pressed into the upper ends of tubes 22 of side sections 13 and 14, respectively, and two further inserts 46 projecting from board 36 are pressed into the upper ends of two of the tubes 24 of back section 15. It will be seen, therefore, that the four chair sections 12–15 are held together in assembled relationship by the boards 35 and 36 and the inserts projecting from these boards which are frictionally accommodated within the ends of certain of the tubes forming the sections.

Slats 37 also can be used to hold the chair sections in assembled condition. Thus, the inserts 49, 50, and 51 projecting from one of the slats 37 can be pressed into the upper ends of one of the tubes 19 of front section 12, one of the tubes 21 of side section 14, and one of the end tubes 23 of back section 15 (see FIG. 7). Similarly, the slat 37 carrying inserts 49', 50', and 51' can be fitted over the side section 13. The inserts 52 projecting from back slat 38 are pressed into the upper ends of two of the tubes 23 of back section 15. In addition to the fact that slats 37 help to hold the assembled sections together, slats 37 and 38 give a finished appearance to the chair, and slats 37 provide a comfortable rest for the arms of the person sitting in the chair.

Figure 9:
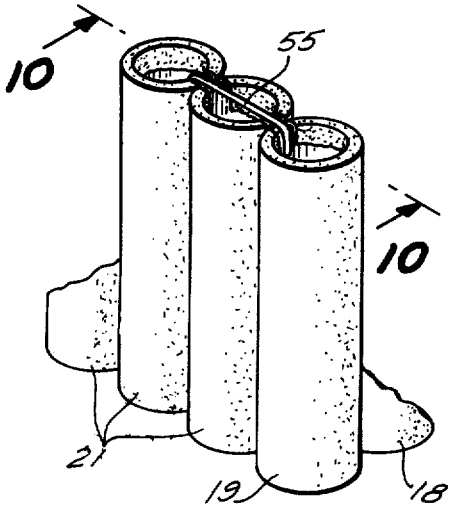
FIG. 9 is a perspective view showing a clip interconnecting tubes forming the chair.
Figure 10:
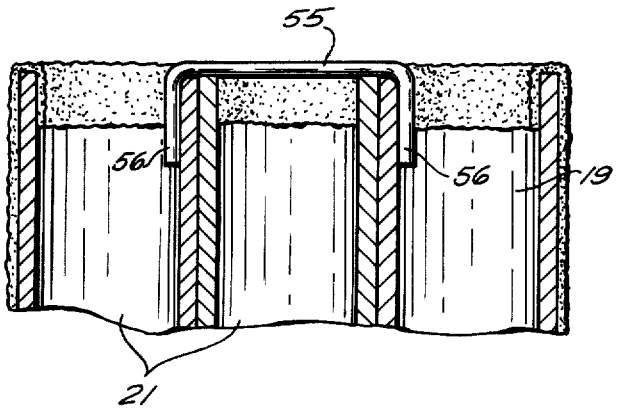
FIG. 10 is a vertical cross-sectional view taken along line 10—10 of FIG. 9.

While boards 35 and 36, and slats 37, are usually sufficient to hold the chair sections in assembled condition, additional fastening means may be employed for this purpose if desired. An example of such fastening means is illustrated in FIGS. 9 and 10. It will be seen that a clip 55 in the form of a U-shaped metal rod is sized so that its ends 56 fit within two alternate tubes having a third tube between them, and tightly squeeze the three tubes together. Specifically, the clip 55 is shown holding together an end tube 19 of front section 12 and two tubes 21 of a side section 13 or 14. In this way, clip 55 holds front section 12 and the side section together.

To increase the comfort of the chair, it is desirable to place a cushion 57 (FIG. 7) on board 36, and a bolster 58 against the back of the chair.

The invention has been shown and described in preferred form only, and by way of example, and many variations may be made in the invention which will still be comprised within its spirit. It is understood, therefore, that the invention is not limited to any specific form or embodiment except insofar as such limitations are included in the appended claims.

What is claimed is:

1. An article of furniture, comprising:
   a. a plurality of rigid tubes arranged vertically in side-by-side relation, some of said tubes being relatively short and some being relatively long,
   b. fastening means connecting said tubes together into a unitary assembly in which all of said tubes are arranged vertically,
   c. a seat defined by horizontal load-supporting means resting upon the upper ends of at least some of said short tubes, and
   d. a back defined by a row of said relatively long tubes, said long tubes being arranged side-by-side with, and fastened to, some of said short tubes.

2. An article of furniture as defined in claim 1 wherein said tubes are made of paper.

3. An article of furniture as defined in claim 1 wherein said fastening means includes an adhesive substance.

4. An article of furniture as defined in claim 1 wherein said fastening means includes staples, each of said staples extending through the side walls of two adjacent tubes.

5. An article of furniture as defined in claim 1 wherein the exposed surfaces of said tubes are covered by sheet material.

6. An article of furniture as defined in claim 1 comprising a plurality of sections, each section being a unitary assembly of said tubes, and means for separably interconnecting said sections together.

7. An article of furniture as defined in claim 6 wherein said interconnecting means includes inserts fixed to said load-supporting means, said inserts being frictionally accommodated within the upper ends of at least some of said tubes.

8. An article of furniture as defined in claim 1 including two additional rows of relatively long tubes defining chair arms, said additional rows of tubes being arranged side-by-side with, and fastened to, some of said short tubes.

9. An article of furniture as defined in claim 1 wherein said load-supporting means is a generally rectangular board and said tubes upon which said board rests are arranged in a rectangular configuration, and including a row of relatively long tubes along each of three sides of said rectangular configuration, each row of long tubes being fastened to the adjacent short tubes of said rectangular configuration and defining, respectively, a chair back and two chair arms, a slat resting upon the upper ends of the long tubes in each row, and inserts fixed to said slat, said inserts being frictionally accommodated within the upper ends of at least some of the long tubes in its respective row.

* * * * *